United States Patent [19]

Lee et al.

[11] Patent Number: 5,001,392

[45] Date of Patent: Mar. 19, 1991

[54] PLASMA DISPLAY DEVICE

[75] Inventors: Seung-Woo Lee; Kyoung-min Kim, both of Seoul, Rep. of Korea

[73] Assignee: Samsung Electronic Devices, Ltd., Rep. of Korea

[21] Appl. No.: 398,420

[22] Filed: Aug. 25, 1989

[30] Foreign Application Priority Data

Dec. 31, 1988 [KR] Rep. of Korea ..... 88-18164

[51] Int. Cl.[5] ..... H01J 17/49; G09G 3/22

[52] U.S. Cl. ..... 313/584; 340/773; 340/774

[58] Field of Search ..... 313/582, 584; 340/714, 340/773, 774

[56] References Cited

U.S. PATENT DOCUMENTS 4,562,434 12/1985 Amano ..... 340/775

4,712,877 12/1987 Okada et al. ..... 350/333 X

*Primary Examiner*—Sandra L. O'Shea

*Attorney, Agent, or Firm*—Leydig, Voit & Mayer

[57] ABSTRACT

A plasma display device and a driving method thereof are disclosed in which cathodes are provided in the form of steps or in the form of depressions and projections to form multistep discharge gaps between the cathodes and anodes, while amplitude modulated pulses, width modulated pulses, or composite width/amplitude modulated pulses are supplied to the cathode or anodes, the pulse amplitudes for the different steps being set in such a manner that the discharges should occur selectively or wholly at the different discharge regions of the different gaps formed by the cathodes. The device of the present invention improves the gray scale to a great extent.

1 Claim, 3 Drawing Sheets

PLASMA DISPLAY DEVICE

FIELD OF THE INVENTION

The present invention relates to a plasma display device and a driving method thereof in which the discharge region is made variable, thereby elevating the gray scale.

BACKGROUND OF THE INVENTION

As shown in FIG. 1, the conventional plasma display device includes matrix-shaped plural anodes 20A and cathodes 40A respectively arranged between a front plate 10A and a rear plate 60A which are fixedly installed relative to each other by means of separating walls 30A. A black layer 50A is disposed between the cathode 40A and the rear plate 60A in order to improve contrast by absorbing external light. Such a plasma display device forms a certain pattern or picture by means of the plasma discharge light released from between the matrix-shaped cathodes and anodes. The brightnesses at the respective resolved picture elements (pixels) of the displayed picture are adjusted by the duration of the discharge and the intensity of the discharge.

The gray scale is determined either by supplying time-modulated pulses as illustrated in FIG. 24A, or by supplying amplitude-modulated pulses of FIG. 2B. However, in most cases, the gray scale is determined by a dual method through the variation of the current supplying time and the voltage level, that is, by supplying the amplitude/time-modulated pulses of FIG. 2C, thereby obtaining a gray scale through a wide range. But there is a limitation in increasing the gray scale through such a method, due to the fact that there are structural limitations such as invariable discharge region, the limitation of the physical characteristics of the cathodes, and the like.

SUMMARY OF THE INVENTION

Therefore it is an object of the present invention to provide a plasma display device in which the gray scale is increased in an efficient manner by improving the structure so that the discharge region is variable.

It is another object of the present invention to provide a method for efficiently driving the plasma display device according to the first object of the present invention.

In achieving the first object, the present invention includes front and rear plates facing each other to define a discharge space therebetween, anodes and cathodes mounted on inner faces of the front and rear plates, respectively, in the form of an x-y matrix, and the cathodes are provided in the form of steps or in the form of depressions and projections, so that multistep discharge gaps are formed in the discharge space between the cathodes and anodes.

In achieving the second object, the method of the present invention includes supplying amplitude-modulated pulses, width-modulated pulses, or composite amplitude-width-modulated pulses to the cathodes or the anodes, and determining amplitudes of the respective steps such that discharges are generated selectively or wholly in the discharge regions of respective gaps formed by the depression and projection type cathodes, when driving a plasma display device having a front plate and a rear plate facing each other, anodes and step-shaped or depression and projection type cathodes mounted respectively on inner surfaces of the front and rear plates to face each other in an X-Y matrix, and separating ribs.

BRIEF DESCRIPTION OF THE DRAWINGS

The above objects and other advantages of the present invention will become more apparent by describing in detail the preferred embodiment of the present invention with reference to the attached drawings in which.

DESCRIPTION OF THE PREFERRED EMBODIMENT

Figure 1:
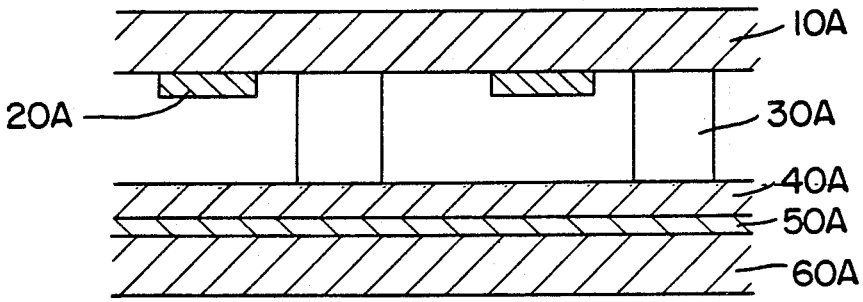
FIG. 1 PRIOR ART
FIG. 1 is a sectional view of the conventional plasma display device.
Figure 2A:
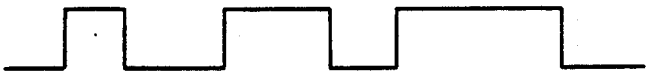
FIG. 2(A) PRIOR ART
FIGS. 2A, 2B and 2C illustrate voltage wave patterns supplied to the cathodes of the conventional plasma display device.
Figure 2B:
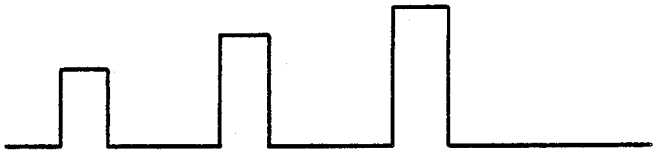
FIG. 2(B) PRIOR ART
Figure 2C:
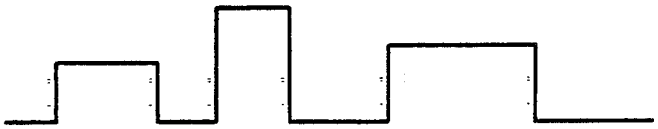
FIG. 2(C) PRIOR ART
Figure 3A:
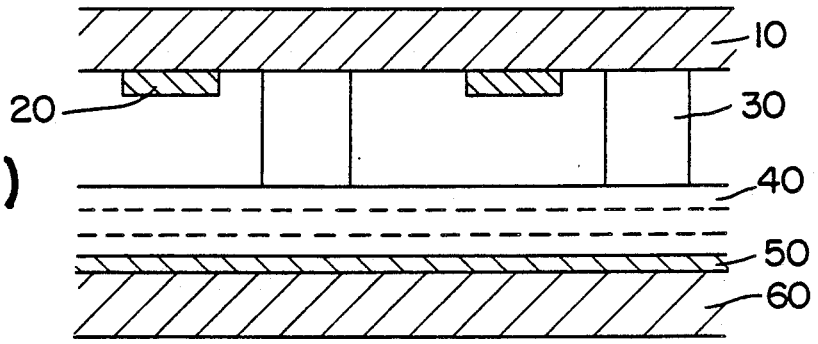
FIGS. 3A and 3B are respectively a longitudinal sectional view and a lateral sectional view of the preferred embodiment of the plasma display device according to the present invention.
Figure 3B:
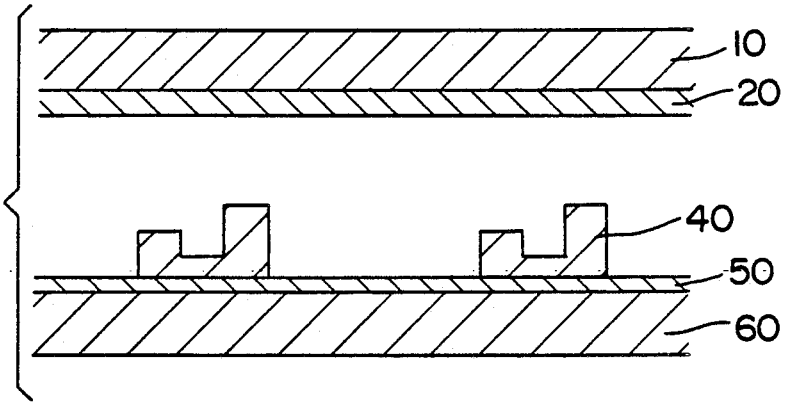

As shown in FIG. 3A and 3B, a front plate 10 and a rear plate 60 are fixedly opposingly installed. Between the front plate 10 and the rear plate 60, a plurality of cathodes 40 and a plurality of anodes 20 are arranged in the form of stripes. The cathodes and the anodes form a matrix shape and are separated by separating ribs 30. Between the cathodes 40 and the rear plate 60, there is installed a black layer 50 for improving the contrast by absorbing the external light.

The cathodes 40 are provided in the form of steps or in the form of depressions and projections, so that the discharge gaps between a cathode 40 and the opposingly located anode 20 are formed between the anode and the surfaces of the steps or the depressions and projections of the cathode 40. It is desirable that each of the cathodes 40 is designed to have a J-shaped cross section as shown in FIG. 3(B), i.e., a depression surrounded on either side by projections, so that the longest discharge gap between the anode 20 and the cathode 40 is formed at the center of the cathode 40 at the depression.

The device of the present invention as described above will now be described as to its operation and as to the most effective driving method thereof.

Figure 4:
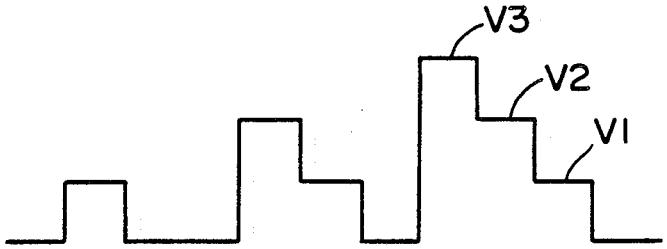
FIG. 4 illustrates a wave pattern of the voltage supplied to the cathodes of the device of FIG. 3.

As shown in FIG. 4, if a simple pulse type voltage or a step shaped pulse type voltage is applied singly or compositely in a sequential manner, the discharge regions will be selected in accordance with the level of the voltage, i.e. the amplitude. Here, V1 represents the initial discharge voltage at the place having the shortest discharge gap, while V2 and V3 represent the initial discharge voltages at the longer and the longest discharge gaps respectively.

Figure 5A:
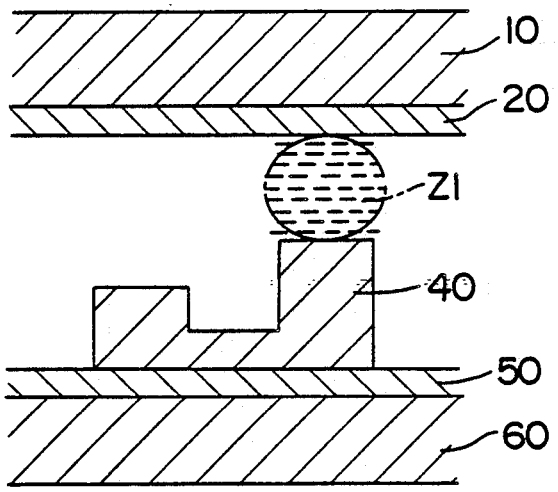
FIGS. 5A, 5B and 5C illustrates stepwise discharge states according to the present invention.
Figure 5B:
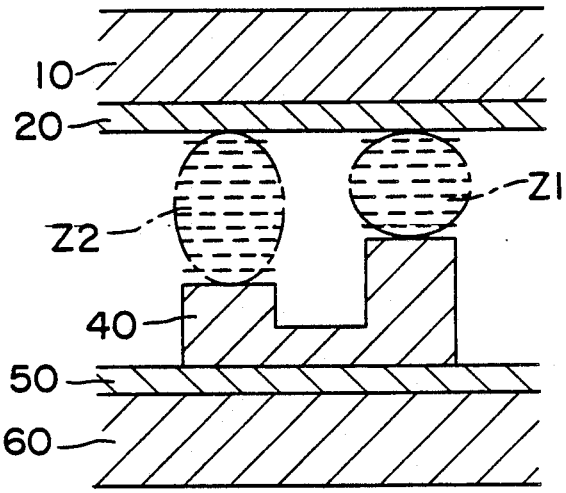
Figure 5C:
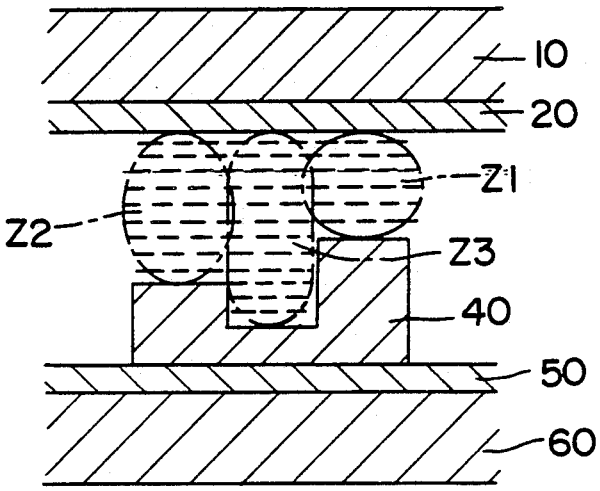

Thus, if the voltage V1 is supplied, first a discharge will occur at the shortest discharge region Z1 as shown in FIG. 5A, and if the voltage V2 is supplied, discharges will occur at the discharge regions Z1, Z2 falling within the dischargeable range as shown in FIG. 5B. IF the highest voltage V3 is supplied, discharges will occur at the discharge region Z1, Z2, Z3 falling within the dischargeable range as shown in FIG. 5C.

Accordingly, depending on the level of voltage supplied, the discharge region varies in width, with the result that the gray scale can be increased. Furthermore, by using a method of supplying amplitude modulated pulses for controlling the time for applying the voltage, a greatly improved gray scale is obtained compared with that which would be expected from conventional plasma display devices.

As described above, the present invention provides a plurality of discharge regions at each of the intersecting positions between the cathodes and the anodes, each of which makes up a pixel. Therefore, depending on the supplied voltage level, discharges can be generated selectively or wholly at each of the intersecting positions, and therefore, the device of the present invention is suitable for use in a computer monitor for graphic design or high resolution television (so-called the high-vision) which is currently being developed. Meanwhile, the device of the present invention can be slightly structurally modified depending on the existence or absence of trigger electrodes, or existence or absence of a dielectric layer foir forming a wall charge, but it should be understood that all the modified types come within the scope of the present invention as long as they are based on the technical conception of the present invention as defined in the appended claims.

What is claimed is:

1. A plasma display device comprising;

a front plate and a rear plate spaced from the front plate to provide a plasma discharge space therebetween, a plurality of cathodes and anodes arranged in an X-Y matrix between said front plate and said rear plate, each cathode facing a corresponding one of the anodes and having, in cross section, a plurality of surfaces of unequal spacing relative to the corresponding anode and including a central depression and projections disposed on both of two opposite sides of the depression to form a plurality of discharge gaps including a relatively long central plasma discharge gap from the depression to the corresponding anode and relatively shorter plasma discharge gaps from the projections to the corresponding anodes.

* * * * *